US008898936B1

(12) United States Patent
Thompson-Boothe et al.

(10) Patent No.: US 8,898,936 B1
(45) Date of Patent: Dec. 2, 2014

(54) FOOTWEAR FASTENING AID

(76) Inventors: Jennifer Thompson-Boothe, South Bend, IN (US); Christopher A. Johnson, South Bend, IN (US)

( * ) Notice: Subject to any disclaimer, the term of this patent is extended or adjusted under 35 U.S.C. 154(b) by 550 days.

(21) Appl. No.: 13/228,064

(22) Filed: Sep. 8, 2011

(51) Int. Cl.
*A43B 11/00* (2006.01)
*A43C 11/00* (2006.01)
*A43C 9/02* (2006.01)

(52) U.S. Cl.
CPC .. *A43B 11/00* (2013.01); *A43C 9/02* (2013.01)
USPC ..... 36/138; 36/50.1

(58) Field of Classification Search
CPC ..... A43B 11/00; A43C 9/02; A43C 11/08; A43C 11/00; A47G 25/80
USPC ..... 36/138, 132, 136, 114, 50.1, 50.5, 51, 36/56
See application file for complete search history.

(56) References Cited

U.S. PATENT DOCUMENTS

| | | | | |
|---|---|---|---|---|
| 669,417 | A | 3/1901 | Klett | |
| 1,139,144 | A * | 5/1915 | Thomas | 223/113 |
| 1,560,124 | A * | 11/1925 | Volkey | 36/1 |
| 2,939,618 | A * | 6/1960 | Mangels | 223/113 |
| 4,646,350 | A | 2/1987 | Batra | |
| 5,027,482 | A | 7/1991 | Torppey | |
| 5,251,388 | A | 10/1993 | Pozzobon et al. | |
| 5,412,852 | A * | 5/1995 | Smaragdas | 24/713.6 |
| 5,572,774 | A | 11/1996 | Duren | |
| 5,657,557 | A * | 8/1997 | Hull et al. | 36/58.5 |
| 5,839,210 | A | 11/1998 | Bernier et al. | |
| 5,974,701 | A | 11/1999 | Busch | |
| 6,283,342 | B1 * | 9/2001 | Wilkerson | 223/112 |
| 7,650,706 | B2 | 1/2010 | Wartel et al. | |
| 7,654,012 | B2 | 2/2010 | Kelley | |
| 2009/0007459 | A1 | 1/2009 | Barmett | |
| 2010/0313445 | A1 | 12/2010 | Hochdoerffer | |
| 2011/0226821 | A1 * | 9/2011 | McGuire | 223/118 |

* cited by examiner

*Primary Examiner* — Jila M Mohandesi
(74) *Attorney, Agent, or Firm* — Botkin & Hall, LLP; Garrick T. Lankford

(57) ABSTRACT

A shoe having a sole and an upper extending from the sole. The upper having an eyelet which carries a strap. The strap extends between a first end and a second end. The second end is attached to the upper and the first end includes a catch. The catch is adapted for manipulation with a dressing stick, such that the dressing stick enables a user to fasten the shoe with the aid of the catch.

6 Claims, 3 Drawing Sheets

FIG.3
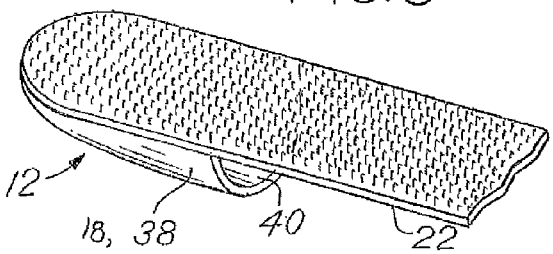
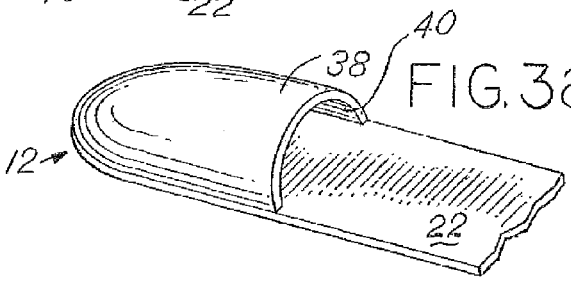
FIG.3a
FIG.4
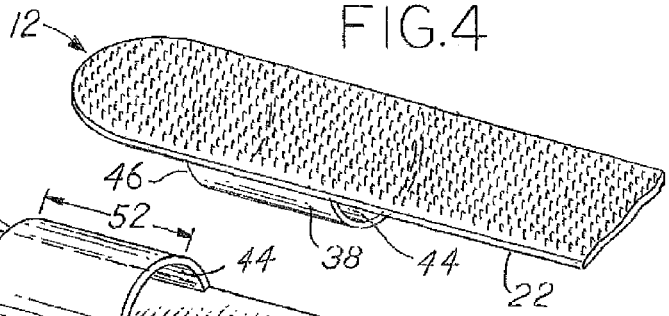
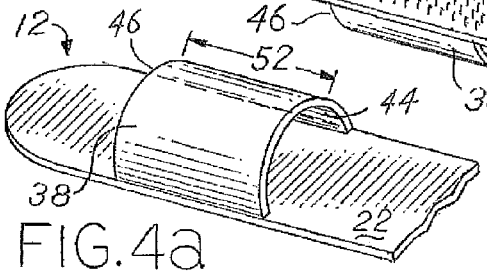
FIG.4a
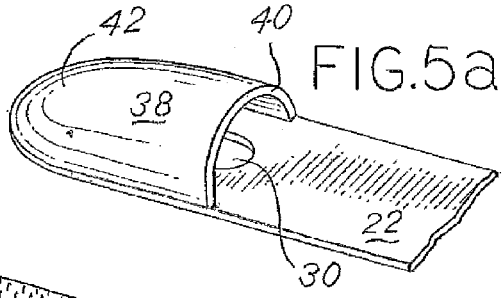
FIG.5a
FIG.5
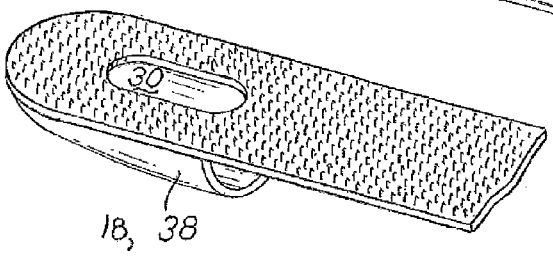

FOOTWEAR FASTENING AID

BACKGROUND OF THE INVENTION

After an injury, a medical procedure, or resultant to the effects of age or obesity, or for other reasons, a person may experience difficulty performing everyday tasks due to limited or reduced mobility. Those with reduced mobility often must compensate for a reduced range of motion by learning to perform everyday tasks in a new way. For example, the once simple task of putting on and fastening shoes can become difficult or impossible for some.

A common tool used by those with limited mobility is a dressing stick. Dressing sticks take many forms, but are typically a stick having a hooked end. A person uses the dressing stick by gripping the stick and using the hook to reach and manipulate objects. Such a tool can be useful for grabbing and moving objects, and helping don articles of clothing, but often proves inadequate for putting on and fastening shoes due to the difficulty in manipulating the shoe and/or laces with the hook.

SUMMARY OF THE INVENTION

The present invention overcomes the problem faced by those with limited mobility by providing a shoe which may be fastened using a dressing stick. The present invention includes a shoe which includes a lace or strap which incorporates a catch for engaging the hook of a dressing stick. By allowing for the lace or strap to be engaged by the dressing stick, a person with limited mobility can use the dressing stick to fasten the shoe.

BRIEF DESCRIPTION OF THE DRAWINGS

A preferred embodiment of this invention has been chosen wherein:

FIG. 3 is a perspective view of another embodiment of the shoe strap.

FIG. 3*a* is a rotated view of FIG. 3.

FIG. 4 is a perspective view of a further embodiment of the strap.

FIG. 4*a* is a rotated view of FIG. 4.

FIG. 5 is a perspective view of an additional embodiment of the strap.

FIG. 5*a* is a rotated view of FIG. 5. and

DESCRIPTION OF THE PREFERRED EMBODIMENT

Figure 1:
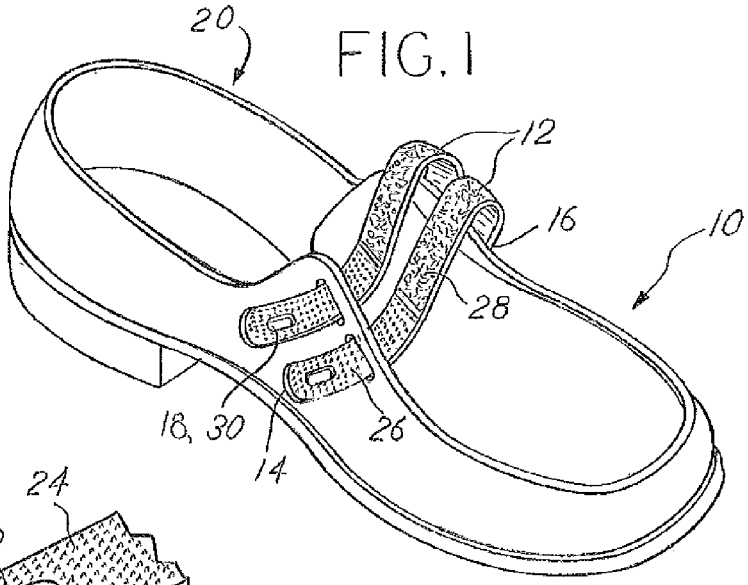
FIG. 1 is a perspective view of one embodiment of the shoe with the straps in an unfastened position.

The present invention relates generally to footwear which is adapted for being manipulated by a dressing stick. More specifically, the present invention relates to footwear which has been modified to allow a person using a dressing stick, or other similar mobility aid, to fasten the footwear despite the person's limited mobility. The footwear may be a shoe, boot, sandal, or any other type of footwear as is known in the art. For simplicity, in this application the footwear is described as a shoe, but this is not meant to limit the type of footwear to which this invention is directed.

The present invention may take several embodiments. As a general matter, the present invention envisions a shoe 10 having a lace or strap 12 which has been modified to include a catch 18 which may be engaged by a hook. Catch 18 may be in the form of an aperture 30 (see FIGS. 1-2*a*), a sheath 38 (see FIGS. 3-4*a*), or a combination thereof (see FIGS. 5-5*a*), as described in more detail below.

In the preferred embodiment, the shoe includes a strap 12 which is secured using a hook and loop fastener. The present invention may be readily adapted by one skilled in the art for use on various other types of shoe fastening apparatus such as buttons, snaps, hooks, clasps, laces and so on.

Generally, shoe 10 is a standard shoe, as is known in the art, having a sole and an upper extending from the sole. The upper is shaped to form a cavity for housing a foot 50. A mouth 20 is an opening formed in the upper for accepting foot 50 into the cavity of shoe 10.

Shoe 10 includes a strap 12 for securing the shoe on the foot of the wearer by drawing the upper close to the foot. Strap 12 extends between a first end 14 and a second end 16. Second end 16 is fixed to the upper of shoe 50. First end 14 is movable between an unfastened and a fastened position. Strap 12 is preferably a generally flat strip having a first side 22 and a second side 24, though other shoe fasteners or laces as are known in the art may be adapted to include a catch as described herein. The first side 22 of strap 12 is typically constructed from fabric, leather, nylon, or other material from which shoes or straps are constructed, and provides the structure of the strap and may be constructed so as to be fashionable and/or match the upper. The second side 24 of strap 12 preferably includes a hook section 26 and a loop section 28 as is known in the art. Shoe 10 includes an eyelet 36 through which strap 12 passes and which serves as a pivot point about which the strap folds between the unfastened and fastened position. The positioning and design of eyelet 36 may vary according to the preferred fit and styling of shoe 50, as is known in the art. A fastening device, other than a hook and loop fastener, may also be used. Strap 12 includes catch 18. Catch 18 includes a hole or opening in strap 12 near first end 14 which is adapted for being engaged by dressing stick 32. In one use of the present invention, the hook 34 of a dressing stick 32 is engaged with catch 18, with the dressing stick so engaged strap 12 is then manipulated into a fastened position.

Figure 2:
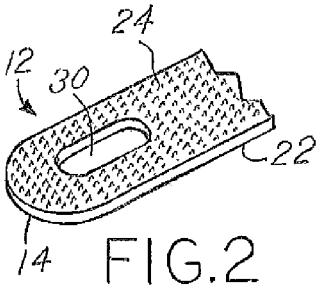
FIG. 2 is a detailed perspective view of one of the straps shown in FIG. 1 in fragmentary form.
Figure 2A:
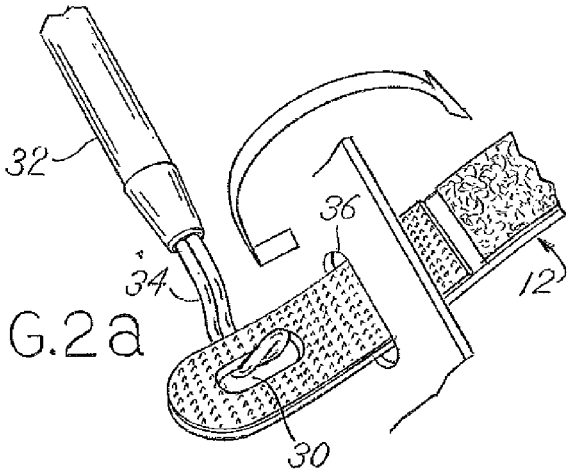
FIG. 2*a* is a detailed perspective view of one of the straps shown in FIG. 1 as engaged by a dressing stick.

Referring now to FIGS. 1-2*a*, FIG. 1 shows shoe 10 with strap 12 in the unfastened position. FIG. 1 shows the shoe having two straps, but the number of straps may vary. Strap 12 includes a catch 18, here illustrated as an aperture 30, near first end 14. As is shown in greater detail in FIG. 2*a*, strap 12 passes through an eyelet 36 in shoe 10. The hook 34 of dressing stick 32 is engageable in aperture 30 and may be used to move strap 12 between the fastened and unfastened positions, as shown in FIG. 2*a*.

In one embodiment, catch 18 includes an aperture 30, or an opening, through strap 12 as shown in FIGS. 1-2*a*. The shape of aperture 30 may vary within the context of this invention. For example, aperture 30 may be shaped as a circle, an oval, a polygonal shape, or any other shape suitable for engagement with a clothes-donning aid. Aperture 30 may be an unadorned hole in strap 12, or may be reinforced in a number of ways. In one embodiment, aperture 30 is formed from metal, such as an O-shaped rivet, with the outer rim of the aperture providing structure to the aperture to hold the aperture open and provide strength to strap 12. In another embodiment, aperture 30 is reinforced with stitching.

Referring now to FIGS. 3-4*a*, in a further embodiment catch 18 includes a sheath 38 extending from first side 22 of strap 12. Sheath 38 includes an opening 40 which is adapted for accepting hook 34 of dressing stick 32 or similar shoe fastening aid. In one embodiment, as shown in FIGS. 3, 3*a*, 5 and 5*a*, sheath 38 terminates in a closed end 42. In an additional embodiment, sheath 38 extends between a first opening 44 and a second opening 46, as shown in FIGS. 4 and 4*a*. The length 52 of the sheath as shown in FIG. 4*a* may vary from an elongated sheath with first opening 44 and second opening 46 spaced apart from one another as is shown in FIG. 4*a*, to a narrow ring extending from strap 12 where first opening 44 and second opening 46 are adjacent one another. Sheath 38 extends from first side 22, such that when strap 12 is in the fastened position, the sheath will extend away from the shoe, and will be engageable with a shoe fastening aid. Additionally, sheath 38 will preferably be constructed of a sufficiently stiff material such that opening 40 will retain its shape and will not collapse during use, such that opening 40 will be easily engageable with a shoe fastening aid. Further, sheath 38 will preferably be adorned similarly to strap 12.

Referring now to FIGS. 5 and 5*a*, in an additional embodiment catch 18 includes both a sheath 38 and an aperture 30. In this embodiment, strap 12 may be manipulated by hook 34 of dressing stick 32 engaging either sheath 38 or aperture 30 or a combination thereof. This embodiment has the advantage of allowing strap 12 when in the unfastened position to be engaged by hook 34 from either first side 22 at aperture 30 and/or sheath 38 or second side 24 at aperture 30. Further, when strap 12 is in the fastened position, hook 34 may be engaged in sheath 38 to aid in unfastening the shoe. This diversity of engagement options of this embodiment allows flexibility to a user 48 in fastening and unfastening shoe 10.

Where catch 18 includes an aperture 30, in one embodiment when strap 12 is in the fastened position aperture 30 overhangs past second end 16 of the strap. In this way hook 24 of dressing stick 32 may easily engage aperture 30 when in the closed position. In this embodiment, strap 12 may be specially adapted to include additional length to allow aperture 30 to overhang past second end 16 of the strap.

Integrating catch 18 into strap 12 provides several advantages. One advantage is that the look of shoe 10 will retain much of the styling of a standard shoe and will not have loops or hooks extending from the end of strap 12 which may detract from the ornamentation of the shoe and make the shoe unappealing to the user. Where catch 18 includes a sheath 38, the sheath may be designed and styled in a way which blends in with the styling of the shoe and minimizes the appearance of the sheath. Another advantage is the usability of such a catch. Where the catch includes an aperture through the strap, the catch will maintain its shape and position on the strap due to the construction of the strap around it—the user will not have to worry about the aperture collapsing or flapping away as it is being manipulated as would be the case with a ring or other device which is not integral with the strap. Where the catch includes a sheath, the sheath would similarly be constructed in a way that wouldn't collapse so that the opening in the sheath would remain open when manipulated, allowing for ease of use.

Figure 6:
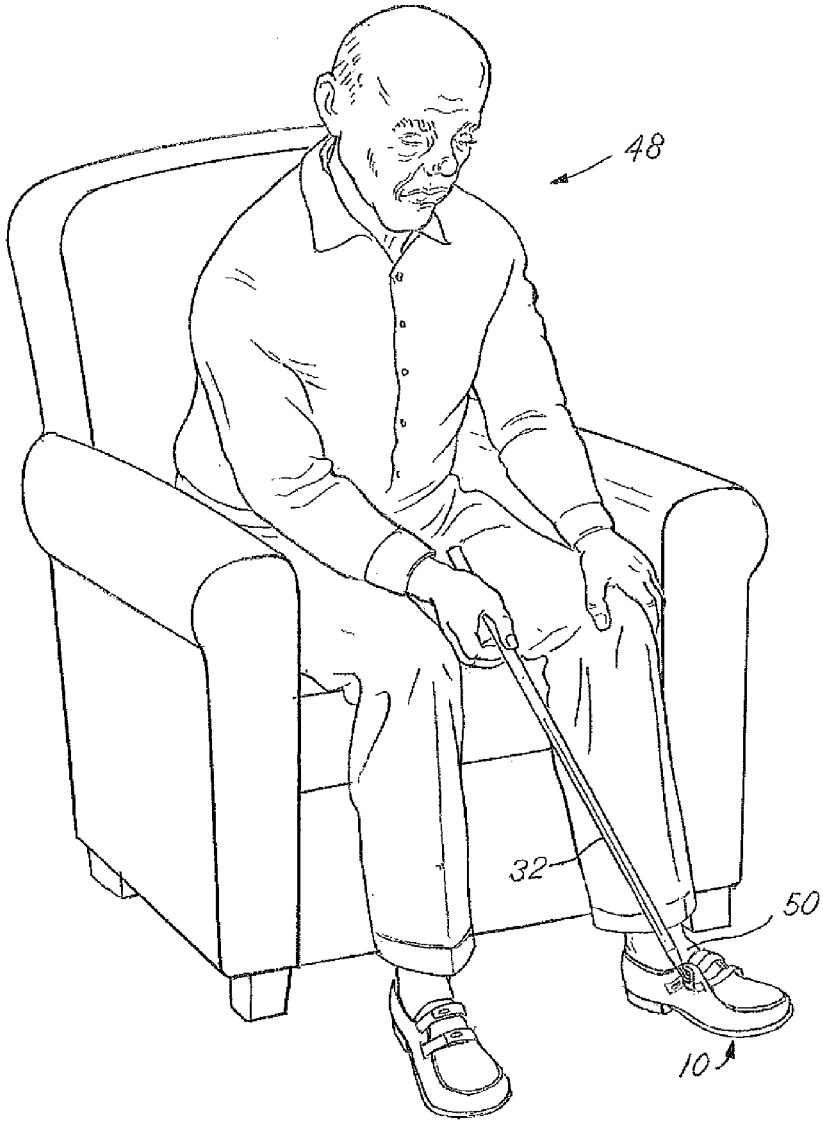
FIG. 6 is a perspective view of a person tightening a strap.

Referring now to FIG. 6, shoe 10 and accompanying catch 18 allow a user 48 to fasten and unfasten strap 12 using a shoe fastening aid, such as a dressing stick 32. Dressing stick 32 may be used to fasten a shoe having a catch 18. Catch 18 may be of any of the embodiments, or variations thereon, described herein. Where catch includes an aperture 30 and/or a sheath 38, it is understood that in the steps below that reference to the catch is understood to include an aperture and/or a sheath.

The shoe 10 is fastened according to the following steps:

a) Inserting a foot 50 into shoe 10;

b) Engaging hook 34 of dressing stick 32 into catch 18 of strap 12;

c) Pulling strap 12 with dressing stick 32 to tighten the upper of shoe 10 around foot 50;

d) Pivoting strap 12 about eyelet 36 such that first end 14 of strap 12 engages second end 16 and is secured in the fastened position, such pivoting aided by dressing stick 32; and e) Disengaging hook 34 from catch 18.

The shoe 10 is unfastened according to the following steps:

a) Engaging hook 34 of dressing stick 32 into catch 18 of strap 12;

b) Pulling strap 12 with dressing stick 32 away from shoe 10 to unfasten first end 14 of strap 12 from second end 16 and moving the strap to the unfastened position;

c) Removing foot 50 from shoe 10; and d) Disengaging hook 34 from catch 18.

The shoe 10 is unfastened according to the following steps:

a) Engaging hook 34 of dressing stick 32 into catch 18 of strap 12;

b) Pulling strap 12 with dressing stick 32 away from shoe 10 to unfasten first end 14 of strap 12 from second end 16 and moving the strap to the unfastened position;

c) Disengaging hook 34 from catch 18; and d) Removing foot 50 from shoe 10.

What is claimed is:

1. A shoe for being used with a dressing stick, said shoe comprising:

a sole and an upper extending from said sole, said upper shaped to form a cavity for accepting a foot, said upper having a mouth for accepting said foot into said cavity;

a strap extending between a first end and a second end, said strap having a first side and a second side with lateral edges, said first end being loose, said second end attached to said upper, said strap having a midpoint located substantially between said first end and said second end, said second side having a hook section and a loop section separated by said midpoint, when said strap is folded substantially about said midpoint, said hook section releasably attaches to said loop section;

an eyelet in said upper adapted for carrying said strap, said strap extending through and pivoting about said eyelet between a fastened and an unfastened position;

a sheath having lateral sides spaced apart by a distance greater than said lateral sides on said strap, said sheath affixed proximate said first end on said first side of said strap, said sheath affixed along lateral sides affixed to said lateral sides on said strap and having an opening overlying said first side of said strap, said sheath spanning between said lateral edges of said strap, said sheath adapted for engagement with a dressing stick.

2. The shoe of claim 1, where said sheath has a first opening and a second opening, forming a cavity between a portion of said first side of said strap and an inner surface of said sheath.

3. The shoe of claim 1, wherein said sheath has an open end and a closed end, said closed end abutting said first end of said strap, said open end opposite said extending from said first side and proximate said first end of said strap.

4. The shoe of claim 3, where said strap includes an aperture passing perpendicularly through said first and second sides of said strap proximate said first end and between said open end and said closed end of said sheath.

5. The shoe of claim 1, where said sheath has a closed end aligned with said first end of said strap and an open end opposite said closed end to form a pocket.

6. The shoe of claim 5, where said strap includes an aperture passing perpendicularly through said first and second sides of said strap proximate said first end and between said open end and said closed end of said sheath.

* * * * *